US009616355B2

(12) United States Patent
Lind

(10) Patent No.: US 9,616,355 B2
(45) Date of Patent: Apr. 11, 2017

(54) CONSTRUCTION KIT

(71) Applicant: Euan Lind Design Limited, Edinburgh (GB)

(72) Inventor: Euan Robert Lind, Edinburgh (GB)

(73) Assignee: Euan Lind Design Limited, Edinburgh (GB)

( * ) Notice: Subject to any disclaimer, the term of this patent is extended or adjusted under 35 U.S.C. 154(b) by 273 days.

(21) Appl. No.: 14/333,614

(22) Filed: Jul. 17, 2014

(65) Prior Publication Data

US 2015/0056886 A1 Feb. 26, 2015

Related U.S. Application Data

(60) Provisional application No. 61/868,204, filed on Aug. 21, 2013.

(51) Int. Cl.
*A63H 33/08* (2006.01)
*A63H 33/06* (2006.01)

(52) U.S. Cl.
CPC ..... *A63H 33/065* (2013.01); *A63H 33/08* (2013.01); *A63H 33/086* (2013.01)

(58) Field of Classification Search
CPC .... A63H 33/062; A63H 33/065; A63H 33/08; A63H 33/086
See application file for complete search history.

(56) References Cited

U.S. PATENT DOCUMENTS

| | | | | |
|---|---|---|---|---|
| 2,066,060 A | | 12/1936 | Sipe | |
| 3,829,938 A | | 8/1974 | Ballin | |
| 4,147,007 A | * | 4/1979 | Eppich | F16B 5/07 446/114 |
| 4,309,852 A | | 1/1982 | Stolpin | |
| 5,006,386 A | | 4/1991 | Menichini | |

FOREIGN PATENT DOCUMENTS

GB 2467305 A 8/2010

* cited by examiner

*Primary Examiner* — John Ricci
(74) *Attorney, Agent, or Firm* — Renner, Otto, Boisselle & Sklar, LLP

(57) ABSTRACT

A construction kit including a plurality of construction assembly pieces each comprising a resilient half rod. The half-rod comprises a rod divided in half longitudinally and having a set of teeth. The set of teeth comprises teeth disposed at intervals along a longitudinal length of said half-rod located in alternate planes to either side of a longitudinal mid-plane of the rod. The teeth are configured to provide a snap-fit interlock with a corresponding set of teeth on the half-rod of an edge of a second corresponding construction assembly piece to define a full, preferably circular cross-section, rod where the two assembly pieces interlock. Each construction assembly pieces defines a flexible plastic rectangle partly open along one edge to allow the rectangle to be flexed further open, for modeling structures having fluid shapes.

19 Claims, 6 Drawing Sheets

FIG. 4
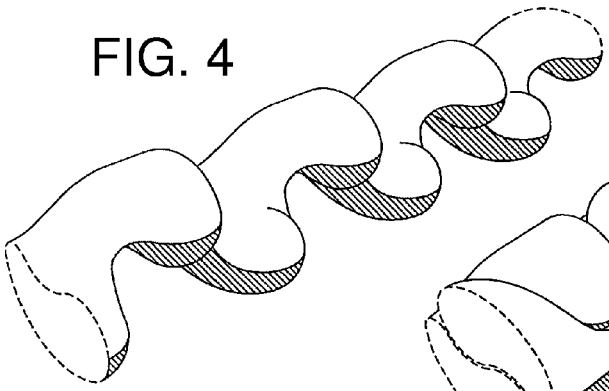
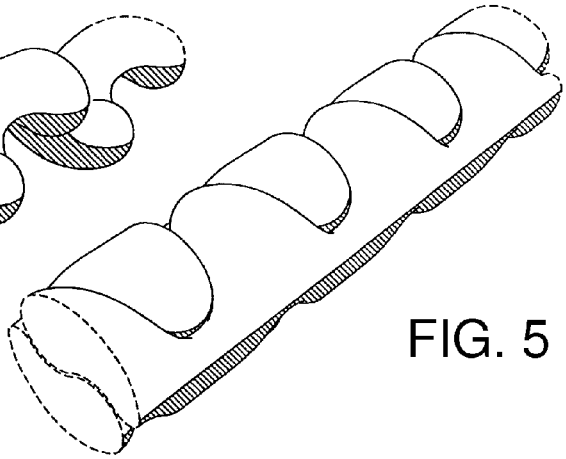
FIG. 5
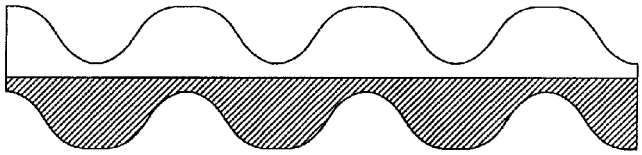
FIG. 6
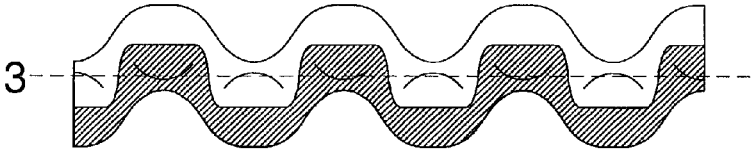
FIG. 7
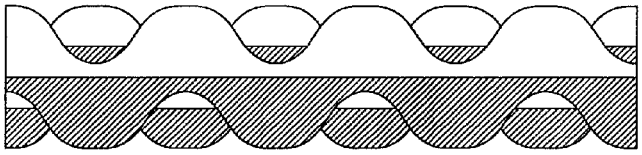
FIG. 8

CONSTRUCTION KIT

RELATED APPLICATION DATA

This application claims the benefit of U.S. Provisional Patent Application No. 61/868,204, filed Aug. 21, 2013, the disclosure of which is incorporated herein by reference in its entirety.

FIELD OF THE INVENTION

This invention relates to a construction kit, and to related methods. The kit is particularly useful for creating fluid forms.

BACKGROUND TO THE INVENTION

There are many different types of construction kit available but the vast majority of these are addressed to making block-like structures using straight lines. We will describe construction kit techniques which are better adapted to creating more organic/fluid structural shapes. Background prior art can be found in:

U.S. Pat. No. 4,309,852 A (STOLPIN) see particularly FIG. 2

GB 2467305 A (CROCOWORLDWIDE et al) whole document

U.S. Pat. No. 3,829,938 A (BALLIN) whole document

U.S. Pat. No. 2,066,060 A (SIPE) whole document

U.S. Pat. No. 5,006,386 A (MENICHINI) whole document

SUMMARY OF THE INVENTION

According to the present invention there is therefore provided a construction kit comprising a plurality of construction assembly pieces, at least two of said construction assembly pieces each comprising a flexible plastic rectangle, wherein said rectangle comprises flexible half rod defining four edges of said rectangle, wherein said rectangle is open along one edge to define two ends of said half rod, wherein said half rod is flexible such that said ends are moveable towards and away from one another to interlock with other said assembly pieces, wherein said half-rod comprises a rod divided in half longitudinally and having a set of teeth; and wherein said set of teeth comprises teeth disposed at intervals along a longitudinal length of said half-rod such that said teeth interlock with a corresponding set of teeth on the half-rod of an edge of a second said construction assembly piece to define a full rod where two of said construction assembly pieces interlock.

The flexible, open structure facilitates the fabrication of shapes such as tubes, spirals of helices and other shapes. A rectangle may be open in the sense that it is not filled in inbetween its edges, or it may contain a flexible/stretchable membrane, for example a light diffusing membrane.

In embodiments the pieces join such that the two half-rods combine longitudinally to provide a full rod with a substantially circular cross section. This facilitates the addition of other pieces to the structure, which may then be clipped over a full rod. A particularly useful shape for such an additional piece is an arcuate shape, for example a flat, flexible shape similar to a segment of a disk. In embodiments the inner curved edge of such a shape may be sized to fit along an edge of the rectangle opposite the open edge, and the outer curved edge may be sized to fit to adjacent such lengths. In this way the piece fits within a rectangle having an open edge stretched by two other similar pieces, clipping over the full rods along either edge of this shape. Again such a shape may be translucent or light-diffusing. Nonetheless in some preferred embodiments of the construction kit at least 50% of the pieces are of the above described "flexible rectangle" type.

In embodiments the teeth are arranged so that there are no hidden surfaces or "negative draught", to simplify injection moulding. More particularly in embodiments the rectangle defines a lateral plane and the teeth are located in first and second planes parallel to this, one above and one below this plane, the teeth being located in alternate vertical positions. Thus along the longitudinal direction along an edge the teeth are located in alternate ones of the first and second planes. A tooth may have a bulbous head to facilitate interlocking of the two half-rod structures.

In preferred embodiments a rectangular piece has rotational symmetry for a 180° rotation about a line in the lateral plane of the rectangle bisecting the open edge of the rectangle and bisecting an edge opposite this open edge.

In some preferred embodiments a piece also has teeth projecting at the corners of a rectangle such that two pieces may be interlocked at their respective corners. In some preferred embodiments pieces may be interlocked in two different ways at their corners, either in a single plane or at a greater than zero dihedral angle, for example an angle of 45° or 120°. Preferably, but not essentially, edges of rectangles joined in this way lie along a common axis.

In embodiments the pieces may also be joined so that they lie in a common plane, more particularly two of the pieces being joined along a common edge sharing a common corner, the third piece having an edge shared with both the first and second pieces, lying to either side of the common corner. This facilitates flexibility in the range of models which may be constructed.

In preferred embodiments a piece is made from flexible plastic, for example by 3D printing or injection moulding. In one arrangement a piece may have teeth along a long edge of the rectangle which enable two similar pieces to be interlocked along with edge at six discrete positions; along the short edge five discrete positions are provided; and along each portion of an open side three discrete positions are provided. Preferably the open side of the rectangle can be expanded such that the open side is substantially twice the length of the opposite side; preferably the open side can be compressed by at least one discrete attachment position. The skilled person will appreciate that these parameters may be varied. In embodiments pieces of a range of different sizes may be provided albeit, in embodiments, with teeth of the same spacing.

Embodiments of the construction kit also provide one or more sub assemblies of a plurality of pieces as described above either temporarily or substantially permanently mutually attached to one another, interlocked to define one or more of a circular structure and a helical structure. The invention also provides a construction assembly piece of a type as described above.

The invention still further provides a method of modelling an architectural structure using a construction kit/construction assembly pieces as described above.

The invention also provides a method of modelling a structure, the method comprising providing data defining a computer aided design (CAD) representation of a structure to be modelled; dividing the structure into a plurality of strips substantially covering the surface of the CAD representation; dividing the strips into rectangles; and assembling the structure using construction assembly pieces as described above, using the flexibility of the pieces to facilitate joining edges of the structure.

The inventors have further recognised that the above described edge-joining techniques may also be employed in applications other than a constructional kit.

Thus in a related aspect the invention provides a construction assembly piece comprising a resilient half rod, wherein said half-rod comprises a rod divided in half longitudinally and having a set of teeth; and wherein said set of teeth comprises teeth disposed at intervals along a longitudinal length of said half-rod configured such that said teeth have a snap-fit interlock with a corresponding set of teeth on the half-rod of an edge of a second said construction assembly piece to define a full rod where two of said construction assembly pieces interlock.

The half-rod may simply comprise the edge of a construction assembly piece, which may elsewhere be of almost any shape. Thus the half-rod may be integrally formed into, say, the edge of a plastic sheet so that only the teeth project. Alternatively the two half rods may clip together to define a full rod having a substantially circular cross-section. Preferably the construction assembly piece is made of plastic.

In embodiments part of a length of a rod has a mid-plane plane extending longitudinally and dividing said rod longitudinally in half. The teeth are located in first and second planes parallel to this mid-plane, and along a longitudinal direction of a said edge the teeth are located in alternate ones of the first and second planes. (The rod may be curved, in which case the reference to planes should be interpreted as applying a tangent to the curve at the relevant part of the rod).

The rods may have corners, a said piece further comprising teeth at a corner such that two of said pieces are inter-lockable at their respective corners. Preferably two of said construction assembly pieces are interlockable such that, when interlocked at a corner, corresponding mid-planes of the respective half-rods of the pieces define mid-planes in different planes at a non-zero angle to one another, and wherein edges of rods of the interlocked pieces at the corner lie along a common axis.

Preferably the teeth at a corner are also configured such that the constructional assembly pieces are interlockable in a configuration where a first and second of three construction assembly pieces share a common corner and where a third of the pieces shares a common edge with both the first and second pieces.

BRIEF DESCRIPTION OF THE DRAWINGS

These and other aspects of the invention will now be further described, by way of example only, with reference to the accompanying figures in which:

FIGS. 4-8 show a structure of half and full rod;

DETAILED DESCRIPTION OF PREFERRED EMBODIMENTS

Broadly speaking we will describe a construction assembly piece or clip comprising a resilient half rod, wherein the half-rod comprises a rod divided in half longitudinally and having a set of teeth. The set of teeth provides an edge-joining mechanism and comprises teeth disposed at intervals along a longitudinal length of said half-rod, located in alternate planes to either side of a longitudinal mid-plane of the rod. The teeth are configured to provide a snap-fit interlock with a corresponding set of teeth on the half-rod of an edge of a second corresponding construction assembly piece to define a full, preferably circular cross-section, rod where the two assembly pieces interlock.

We also describe a construction kit comprising a plurality of such pieces each defining a flexible plastic rectangle partly open along one edge to allow the rectangle to be flexed further open, for modelling structures having fluid shapes.

Figure 1:
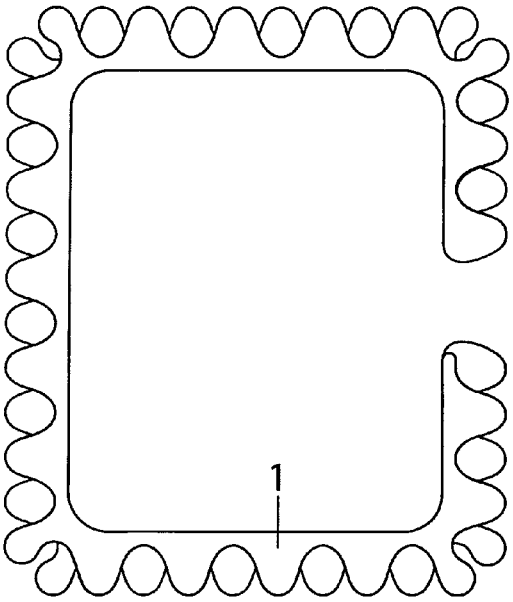
FIGS. 1-3 show a single construction element.
Figure 2:
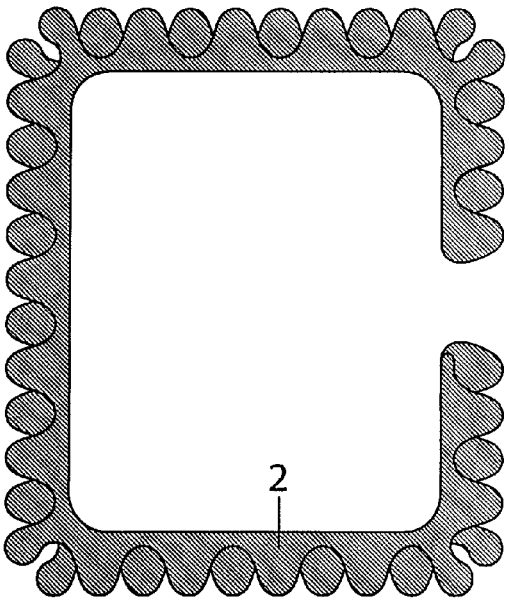
Figure 3:
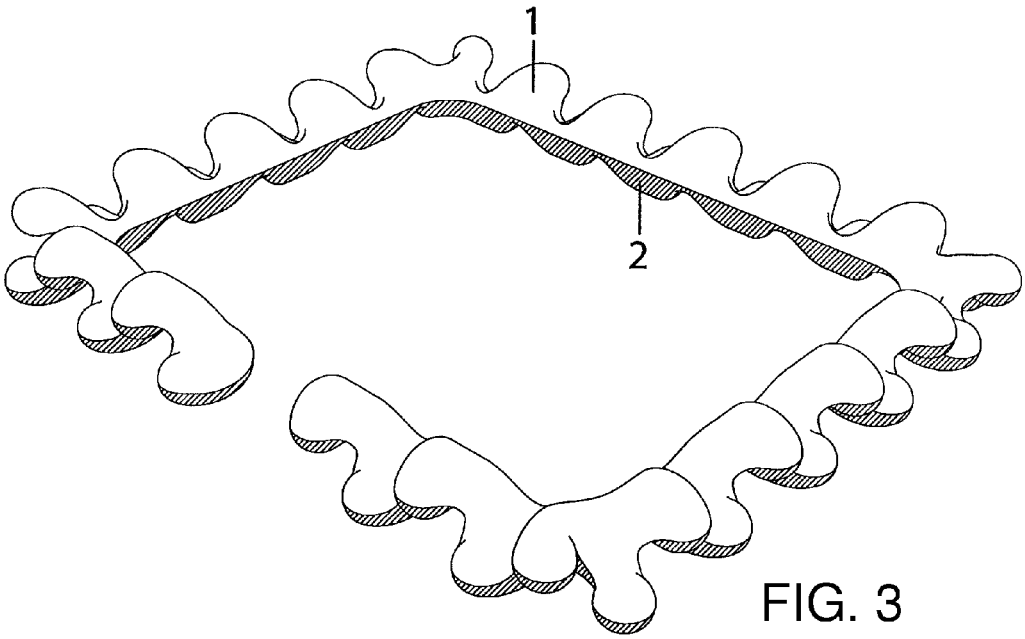

We now describe some preferred embodiments with reference to the figures:

FIGS. 1-3, Single Construction Element

FIG. 1—Plan view of single construction assembly piece.

FIG. 2—Bottom view of said piece.

FIG. 3—Perspective view of said piece.

All white areas indicated by reference 1 show surface areas which in the process of injection moulding would be formed by one half of the mould. All hatched areas marked 2 show areas formed by the second half of said mould. That exactly half the surface is visible in FIG. 1 and half in FIG. 2 with no additional hidden areas demonstrates that this geometry is mouldable using a 2 part injection moulding process.

FIGS. 4-8, Structure of Half and Full Rod

As in FIGS. 1-3, surface area above the mould split line is shown white and area below is shown hatched.

FIG. 4—Perspective view of half rod.

FIG. 5—Perspective view of full rod.

FIG. 6—Back view of half rod.

FIG. 7—Front view of half rod. The dashed line indicated by reference number 3 shows the mid-plane. The tips of the teeth on either side of this line protrude through the mid-plane such that a small amount of force is required to clip the pieces together. When the teeth are engaged to form a section of full rod they lock together in such a way that they are self bracing against rotational force (around the central axis of the full rod) applied to either piece.

FIG. 8—FIGS. 6 and 7 combined to create full rod.

Figure 9:
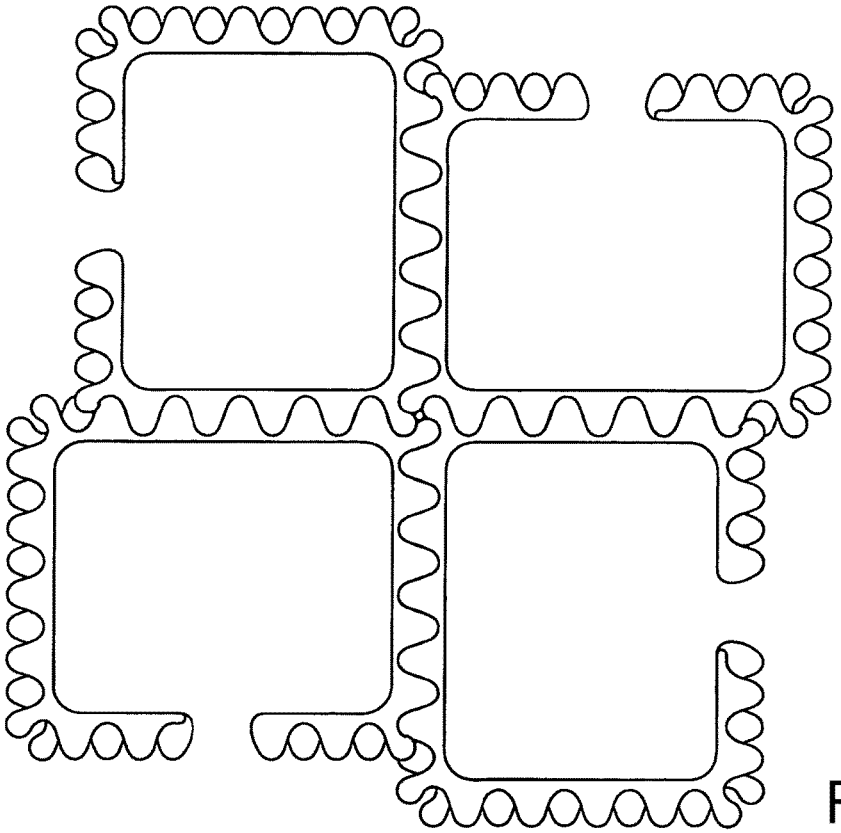
FIGS. 9-10 show interconnectability of elements.
Figure 10:
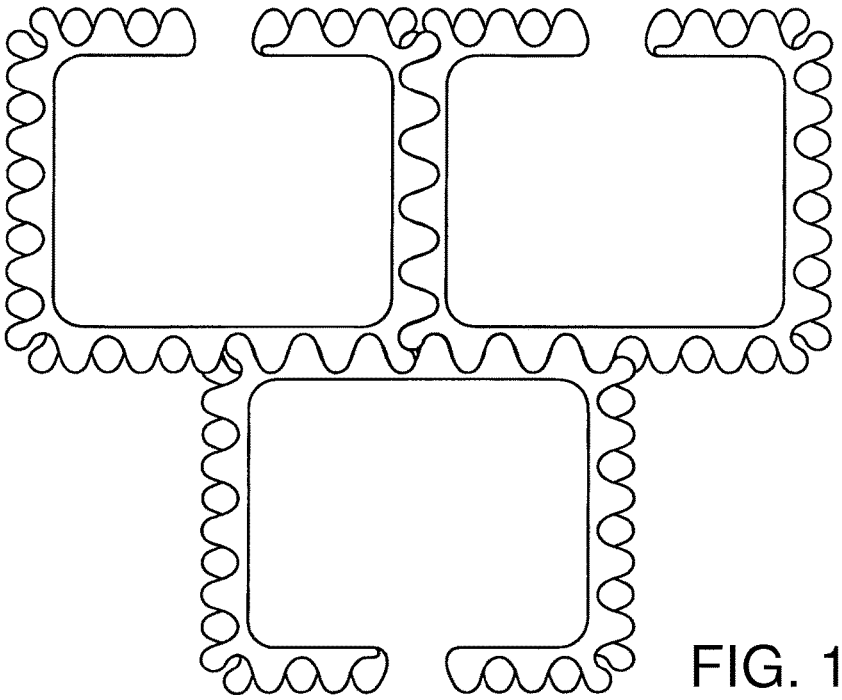

FIGS. 9 and 10, Interconnectability of Elements

FIG. 9—Plan view of 4 connected elements where all share a common corner.

FIG. 10—Plan view of 3 connected elements where first and second share a common corner and where a third of the pieces shares a common edge with both the first and second pieces.

Figure 11:
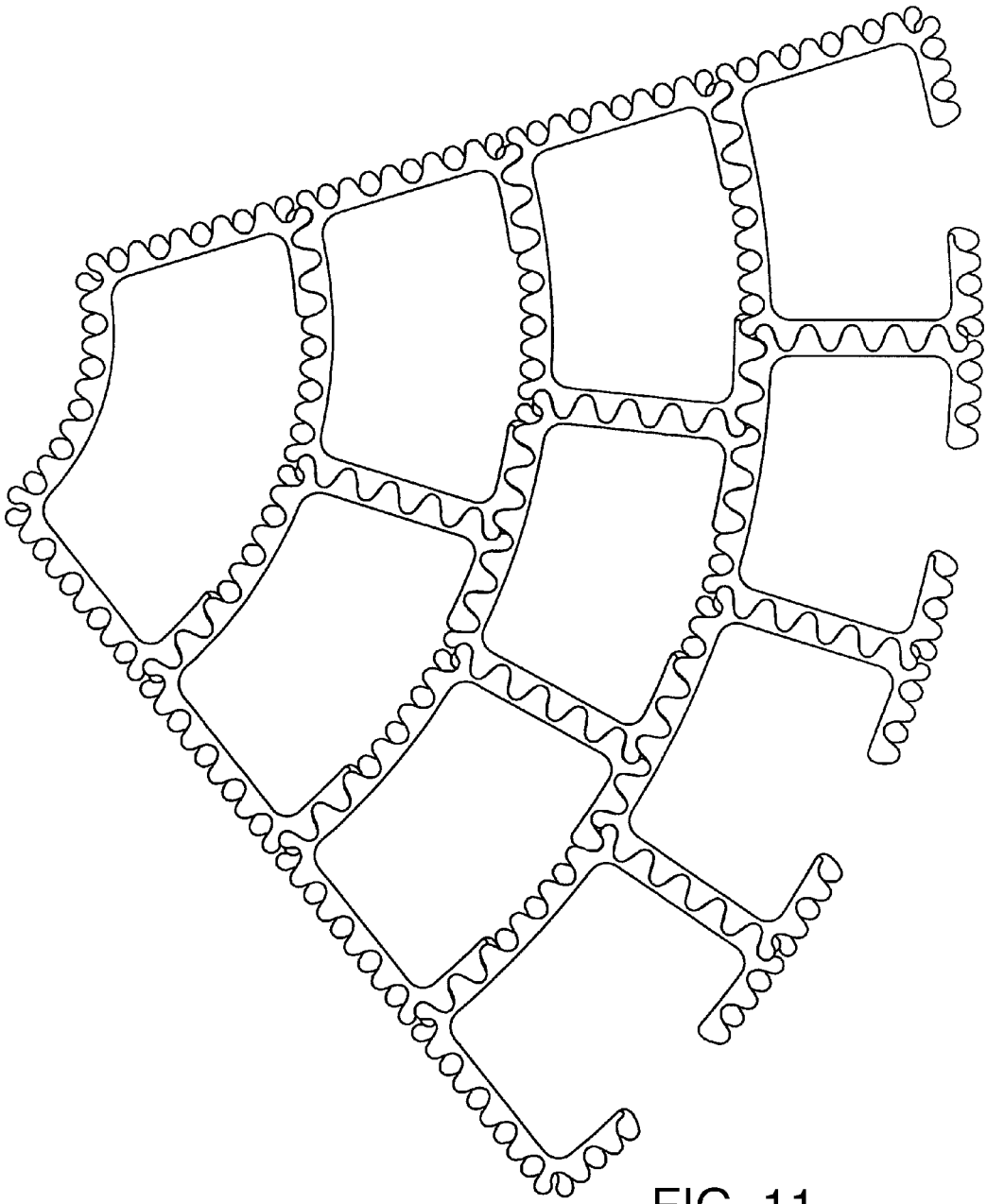
FIGS. 11-12 show construction of non-rectilinear and 3 dimensional assemblies.
Figure 12:
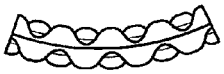

FIGS. 11 and 12, Construction of Non-Rectilinear and 3 Dimensional Assemblies FIG. 11—Plan view of an example 2 dimensional planar assembly which can be made by deforming individual elements as shown.

FIG. 12—Side view of a section of full rod showing how individual and connected elements can also be deformed by bending in a direction perpendicular to that in FIG. 11.

Three dimensional assemblies arise when discrete elements are flexed in both of these perpendicular directions.

Figures 13, 14, 15:
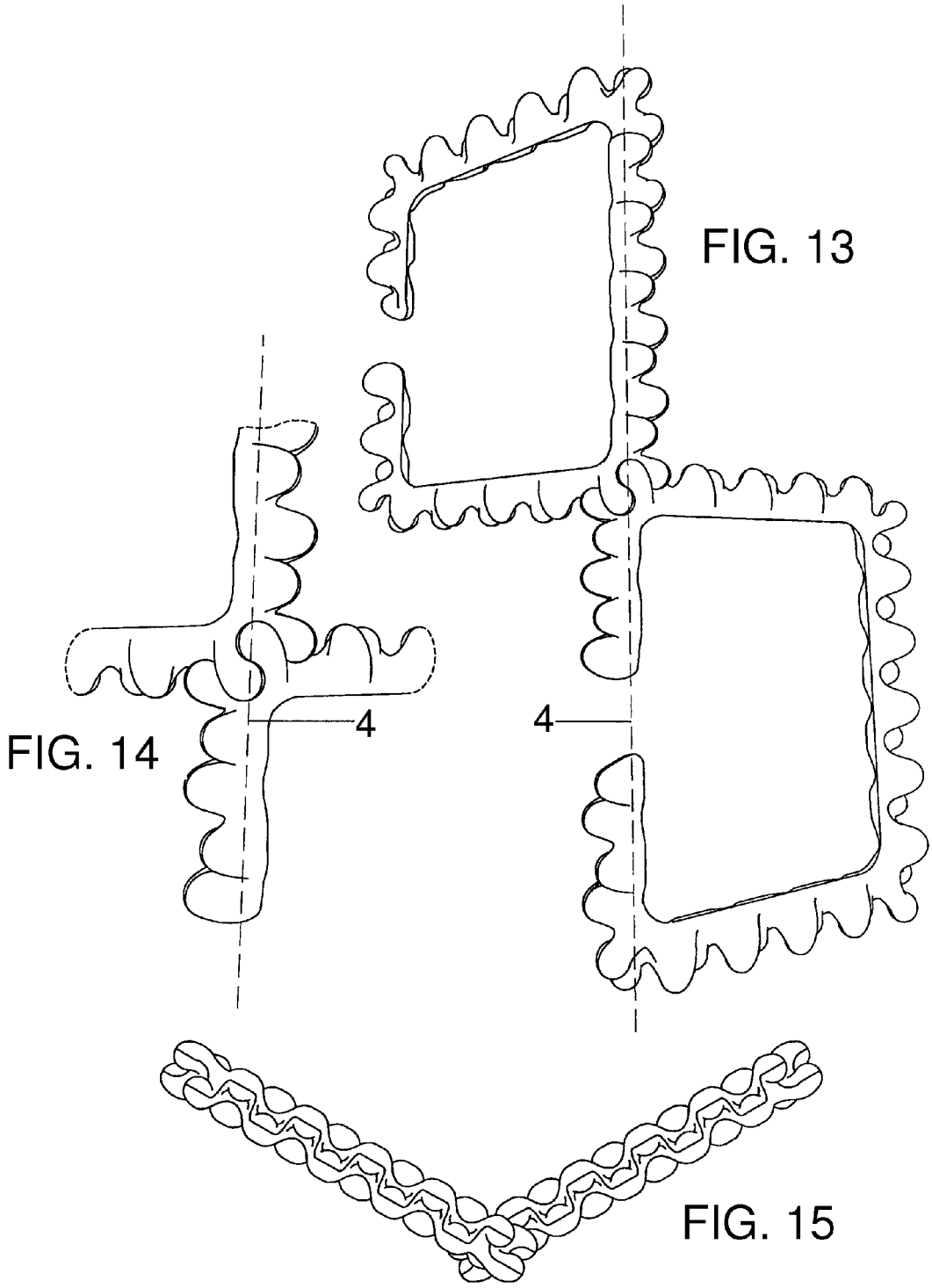
FIGS. 13-15 show a complementary connection method.

FIGS. 13-15. Complementary Connection Method

FIG. 13—Perspective view of 2 assembly pieces connected using alternative method.

FIG. 14—Perspective Detail of Join.

FIG. 15—Plan view of FIG. 13.

Two pieces are inter-lockable at their respective corners such that, when interlocked at a corner, corresponding mid-planes of the respective half-rods of the pieces define mid-planes in different planes at a non-zero angle to one another, and wherein edges of rods of the interlocked pieces at the corner lie along a common axis. In FIGS. 13 and 14 a dashed line marked by reference number 4 indicates said common axis .

Figure 16:
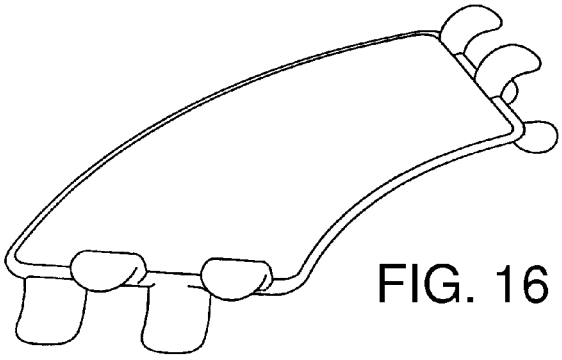
FIGS. 16-18 show flexible arcuate panels.
Figure 17:
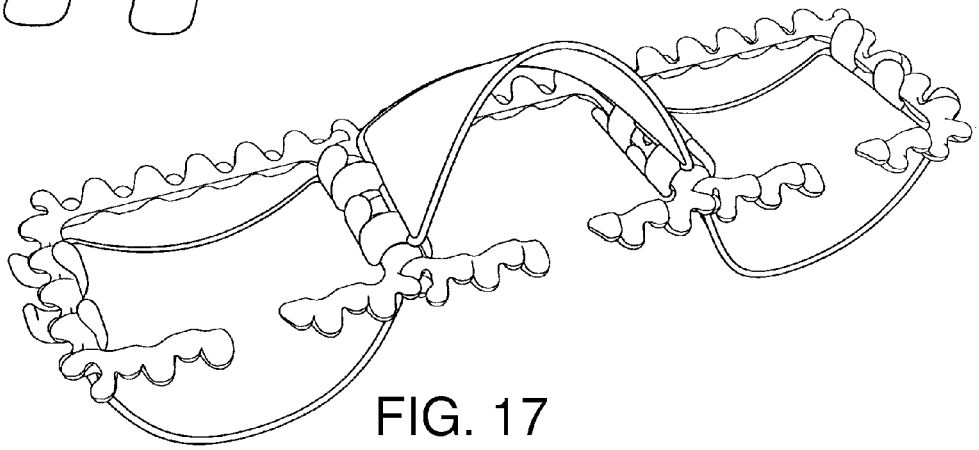
Figure 18:
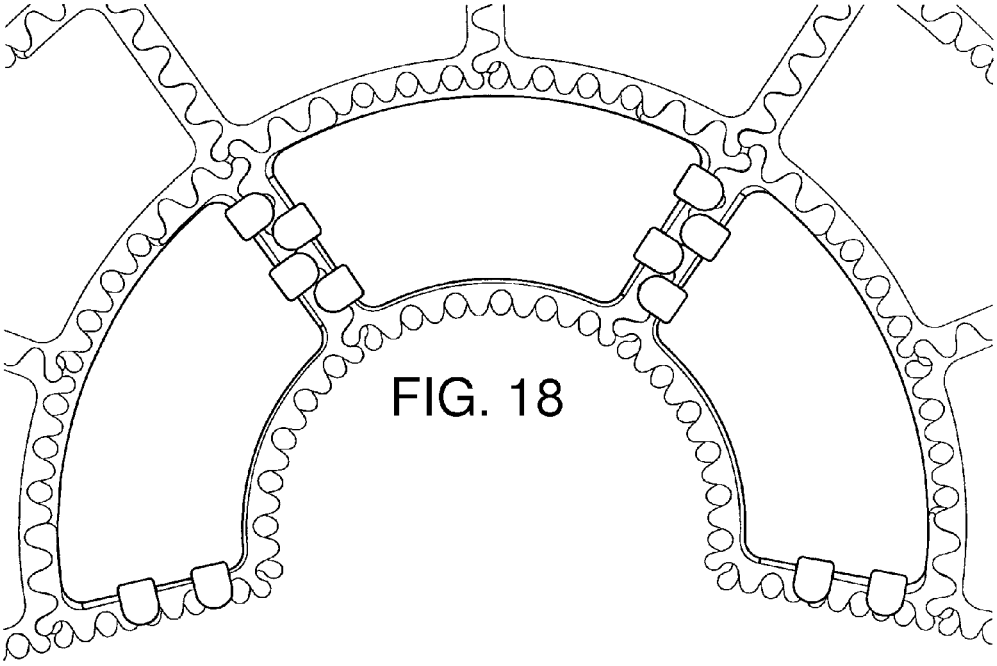

FIGS. 16-18. Flexible Arcuate Panels

FIG. 16—Perspective view of clip-on flexible arcuate panel.

FIG. 17—Perspective view of assembly where panels are deformed to conform to rectilinear constraints.

FIG. 18—Plan view of clip on arcuate panels within a planar assembly. In this arrangement the panels are shown in an unflexed position at their maximum span.

These arcuate panels are malleable such that they can accommodate all possible deformations of the substructure from the rectilinear shape shown in FIG. 17 to the extreme arcuate shape of FIG. 18.

No doubt many other effective alternatives will occur to the skilled person. It will be understood that the invention is not limited to the described embodiments and encompasses modifications apparent to those skilled in the art lying within the spirit and scope of the claims appended hereto.

The invention claimed is:

1. A construction assembly piece comprising a resilient half rod, wherein said half-rod comprises a rod divided in half longitudinally and having a set of teeth;

wherein said set of teeth comprises teeth disposed at intervals along a longitudinal length of said half-rod configured such that said teeth have a snap-fit interlock with a corresponding set of teeth on the half-rod of an edge of a second said construction assembly piece to define a full rod where two of said construction assembly pieces interlock; and wherein said full rod has a substantially circular cross-section.

2. A construction assembly piece comprising a resilient half rod, wherein said half-rod comprises a rod divided in half longitudinally and having a set of teeth;

wherein said set of teeth comprises teeth disposed at intervals along a longitudinal length of said half-rod configured such that said teeth have a snap-fit interlock with a corresponding set of teeth on the half-rod of an edge of a second said construction assembly piece to define a full rod where two of said construction assembly pieces interlock;

wherein part of a length of a said rod has a mid-plane plane extending longitudinally and dividing said rod longitudinally in half, wherein said teeth are located in first and second planes parallel to said mid-plane, and wherein along a longitudinal direction of a said edge said teeth are located in alternate ones of the first and second planes.

3. A construction assembly piece comprising a resilient half rod, wherein said half-rod comprises a rod divided in half longitudinally and having a set of teeth;

wherein said set of teeth comprises teeth disposed at intervals along a longitudinal length of said half-rod configured such that said teeth have a snap-fit interlock with a corresponding set of teeth on the half-rod of an edge of a second said construction assembly piece to define a full rod where two of said construction assembly pieces interlock;

wherein said rods have corners, a said piece further comprising said teeth at a said corner such that two of said pieces are inter-lockable at their respective said corners;

wherein part of a length of a said rod has a mid-plane plane extending longitudinally and dividing said rod longitudinally in half, wherein said teeth are located in first and second planes parallel to said mid-plane, and wherein along a longitudinal direction of a said edge said teeth are located in alternate ones of the first and second planes; and wherein two of said construction assembly pieces are interlockable such that, when interlocked at a said corner, corresponding said mid-planes of the respective half-rods of the pieces define mid-planes in different planes at a non-zero angle to one another, and wherein edges of rods of said interlocked construction assembly pieces at said corner lie along a common axis.

4. A construction assembly piece comprising a resilient half rod, wherein said half-rod comprises a rod divided in half longitudinally and having a set of teeth;

wherein said set of teeth comprises teeth disposed at intervals along a longitudinal length of said half-rod configured such that said teeth have a snap-fit interlock with a corresponding set of teeth on the half-rod of an edge of a second said construction assembly piece to define a full rod where two of said construction assembly pieces interlock;

wherein said rods have corners, a said piece further comprising said teeth at a said corner such that two of said pieces are inter-lockable at their respective said corners; and wherein said teeth at a said corner are configured such that three constructional assembly pieces are interlockable in a configuration where a first and second of said three construction assembly pieces share a common corner and where a third of said construction assembly pieces shares a common edge with both said first and second construction assembly pieces, and wherein said construction assembly piece comprises a flexible plastic said half rod.

5. A construction kit comprising a plurality of construction assembly pieces each comprising a resilient half rod, wherein said half-rod comprises a rod divided in half longitudinally and having a set of teeth; and wherein said set of teeth comprises teeth disposed at intervals along a longitudinal length of said half-rod configured such that said teeth have a snap-fit interlock with a corresponding set of teeth on the half-rod of an edge of a second said construction assembly piece to define a full rod where two of said construction assembly pieces interlock, at least two of said construction assembly pieces each comprising a flexible plastic rectangle, wherein said rectangle comprises a said flexible half rod defining four edges of said rectangle, and wherein said rectangle is open along one edge to define two ends of said half rod, wherein said half rod is flexible such that said ends are moveable towards and away from one another to interlock with other said assembly pieces.

6. A construction kit as claimed in claim 5 wherein a said construction assembly piece has rotational symmetry about a line in said lateral plane bisecting said open edge of said rectangle and an edge of said rectangle opposite said open edge.

7. A construction kit as claimed in claim further 5 comprising at least one further said construction assembly piece configured to clip over a said full rod.

8. A construction kit as claimed in claim 7 wherein said further construction assembly piece is shaped to define an arcuate shape having an inner curved edge sized to fit along an edge of said rectangle opposite said open edge and having an outer curved edge sized to fit two such adjacent lengths such that said further construction assembly piece fits within a said construction assembly piece with an open edge stretched by two other said constructional assembly pieces.

9. A construction kit as claimed in claim 5 wherein said construction assembly piece comprises a flexible plastic rectangle with edges defined by a flexible plastic said half rod.

10. A construction kit comprising a plurality of construction assembly pieces, at least two of said construction assembly pieces each comprising a flexible plastic rectangle, wherein said rectangle comprises flexible half rod defining four edges of said rectangle, wherein said rectangle is open along one edge to define two ends of said half rod, wherein said half rod is flexible such that said ends are moveable towards and away from one another to interlock with other said assembly pieces, wherein said half-rod comprises a rod divided in half longitudinally and having a set of teeth; and wherein said set of teeth comprises teeth disposed at intervals along a longitudinal length of said half-rod such that said teeth interlock with a corresponding set of teeth on the half-rod of an edge of a second said construction assembly piece to define a full rod where two of said construction assembly pieces interlock.

11. A construction kit as claimed in claim 10 wherein said full rod has a substantially circular cross-section.

12. A construction kit as claimed in claim 10 wherein said rectangle defines a lateral plane, wherein said teeth are located in first and second planes parallel to said lateral plane of said rectangle, and wherein along a longitudinal direction of a said edge said teeth are located in alternate ones of the first and second planes.

13. A construction kit as claimed in claim 12 wherein a said construction assembly piece has rotational symmetry about a line in said lateral plane bisecting said open edge of said rectangle and an edge of said rectangle opposite said open edge.

14. A construction kit as claimed in claim 10 further comprising said teeth at corners of said rectangle such that two of said pieces are inter-lockable at their respective said corners.

15. A construction kit as claimed in claim 14 wherein two of said construction assembly pieces are interlockable such that when interlocked at a said corner said rectangles define lateral planes in different planes at a non-zero angle to one another, and wherein edges of said rectangles of said interlocked construction assembly pieces at said corner lie along a common axis.

16. A construction kit as claimed in claim 14 wherein said teeth at a said corner are configured such that constructional assembly pieces are interlockable in a configuration where a first and second of said three construction assembly pieces share a common corner and where a third of said construction assembly pieces shares a common edge with both said first and second construction assembly pieces.

17. A construction kit as claimed claim 10 further comprising at least one further said construction assembly piece configured to clip over a said full rod.

18. A construction kit as claimed in claim 17 wherein said further construction assembly piece is shaped to define an arcuate shape having an inner curved edge sized to fit along an edge of said rectangle opposite said open edge and having an outer curved edge sized to fit two such adjacent lengths such that said further construction assembly piece fits within a said construction assembly piece with an open edge stretched by two other said constructional assembly pieces.

19. A construction kit as claimed in claim 10 wherein said construction assembly piece comprises a flexible plastic rectangle with edges defined by a flexible plastic said half rod.

* * * * *